US006007113A

United States Patent [19]

Prevot et al.

[11] Patent Number: 6,007,113

[45] Date of Patent: Dec. 28, 1999

[54] ADJUSTABLE BOLT FITTING FOR SLIDING DOOR CLOSURE

[75] Inventors: Gérard Prevot, Willerwald; Gérard Desplantes, Sarrebourg; Eric Alvarez, Hommert, all of France

[73] Assignee: Ferco International Ferrures et Serrures de Batiment, Reding, France

[21] Appl. No.: 09/055,006

[22] Filed: Apr. 3, 1998

[30] Foreign Application Priority Data

Apr. 3, 1997 [FR] France ..... 97 04068

[51] Int. Cl.[6] ..... E05C 19/00

[52] U.S. Cl. ..... 292/2; 292/95; 292/116; 292/DIG. 60

[58] Field of Search ..... 292/2, 95, 116, 292/341.19, DIG. 64, 175, 340, 341.18, DIG. 60, DIG. 53; 411/354, 403, 437

[56] References Cited

U.S. PATENT DOCUMENTS

| | | | |
|---|---|---|---|
| 2,814,543 | 11/1957 | Siegel | 292/341.18 |
| 4,099,758 | 7/1978 | Yamamoto et al. | 292/341.18 |
| 4,200,027 | 4/1980 | Oehlke | 85/36 |
| 4,623,176 | 11/1986 | Clausen | 292/74 |
| 4,856,832 | 8/1989 | Prevot | 292/341.19 |
| 4,911,489 | 3/1990 | Hansen et al. | 292/336.3 |
| 4,913,610 | 4/1990 | Olivieri | 411/352 |

*Primary Examiner*—Darnell M. Boucher
*Assistant Examiner*—John B. Walsh
*Attorney, Agent, or Firm*—Kenyon & Kenyon

[57] ABSTRACT

In a lock fitting for sliding closures the bolt-carrier has at least one slot to receive the tail of a bolt carrying at least one hook and includes at least one screwthreaded hole having an axis perpendicular to the walls of the slot to receive an immobilizing screw for immobilizing the tail of the bolt against the wall of the slot opposite the immobilizing screw. The tail of the bolt includes at least one opening extending in the longitudinal direction of the slot and the screw bears on at least one edge of the opening.

11 Claims, 4 Drawing Sheets

47
46
45
47
48
24
48a
49
12
13
13
24
48
49
12
71
72
73
16
9
8a
8b
52
A
24
13
7
12
25
21
49
50
47

ADJUSTABLE BOLT FITTING FOR SLIDING DOOR CLOSURE

BACKGROUND OF THE INVENTION

1. Field of the Invention

The present invention concerns an adjustable bolt fitting for sliding door, window or like closures.

2. Description of the Prior Art

One prior art adjustable bolt sliding door, window or like closure fitting includes a bolt-carrier having at least one slot adapted to receive the tail of a bolt carrying at least one hook, the bolt-carrier being adapted to slide in the transverse direction of the slot to engage the hook of the bolt with a striker on the frame and to release the hook from the striker, the bolt being adapted to slide in the longitudinal direction of the slot to adjust the bolt relative to said striker, the bolt-carrier including at least one screwthreaded hole having an axis perpendicular to the walls of the slot and adapted to receive an immobilizing screw for immobilizing the tail of the bolt against the wall of the slot in the bolt-carrier opposite the screw.

The above fitting is adapted to receive a bolt with two hooks. The tail of the bolt has on its longitudinal edges teeth formed on only a part of its thickness. Adjusting the hook relative to the striker in the longitudinal direction of the tail of the bolt requires three holes on the outside wall of the fitting, two holes receiving grubscrews for immobilizing the bolt and a hole through which a tool is passed to press on the teeth of one edge to adjust the bolt in the closed position of the closure.

The presence of the aforementioned three holes weakens the bolt-carrier and is entirely undesirable from the esthetic point of view in so far as the outside plate is concerned.

FR-A-2 591 267 describes an adjustable bolt lock for sliding closures. The bolt includes a longitudinal groove adapted to receive an adjuster screw with its axis parallel to the median axis of the tail of the bolt and which cooperates with a screwthreaded hole in the slot of the bolt-carrier that receives the tail of the bolt. The bolt includes a longitudinal recess providing access to the adjuster screw. A screw for immobilizing the bolt is accommodated in an inclined screwthreaded hole opening onto a lateral face of the bolt-carrier.

This fitting also implies a weak structure of the bolt-carrier. Also, the bolt is adjusted with the closure open and the closure must then be closed to see if the position chosen for the bolt is appropriate to the corresponding striker. It is therefore necessary to proceed by trial and error before a satisfactory adjustment of the bolt is achieved.

The aim of the present invention is to remedy the drawbacks of the prior art fittings and to propose a fitting of the above type including a solid structure bolt-carrier adapted to receive completely reversible bolts and to allow the bolt to be adjusted with the closure in the closed position, if necessary.

SUMMARY OF THE INVENTION

In accordance with the invention, in a fitting of the above type the tail of the bolt includes at least one opening extending in the longitudinal direction of the slot and the screw is adapted to bear on at least one edge of the opening.

The presence of an opening facilitates deforming the tail of the bolt by the pressure applied by the screw so that a single screw is sufficient to assure satisfactory immobilization of the tail of the bolt inside the slot of the bolt-carrier.

The structure of the bolt-carrier has no weak points. A bolt-carrier of the above kind can be adapted to suit several types of completely reversible bolts.

Other features and advantages of the present invention will become apparent in the following detailed description given by way of non-limiting example only with reference to the appended drawings.

DETAILED DESCRIPTION OF THE PREFERRED EMBODIMENTS

Figure 3:
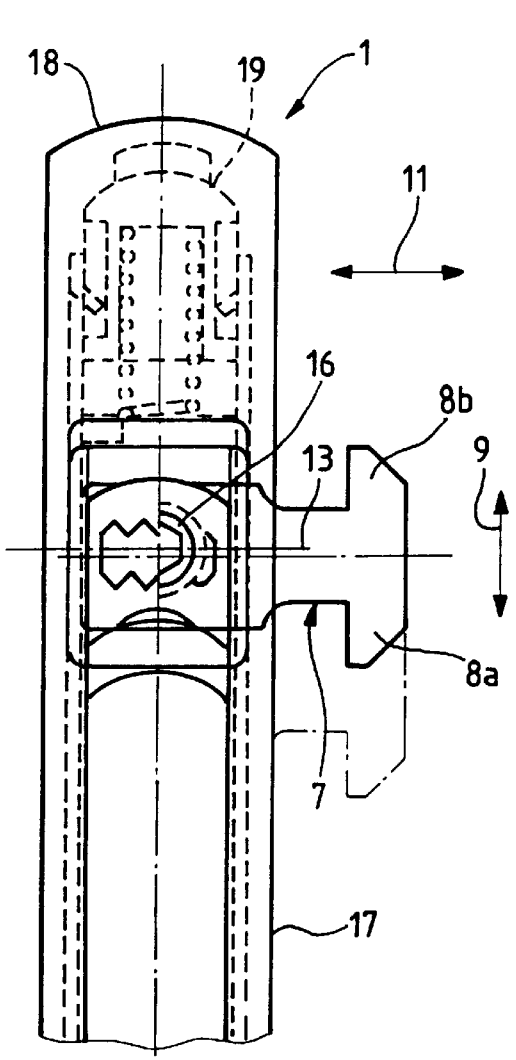
FIG. 3 is a view of the fitting from FIG. 1 as seen from the left in FIG. 1.
Figure 1:
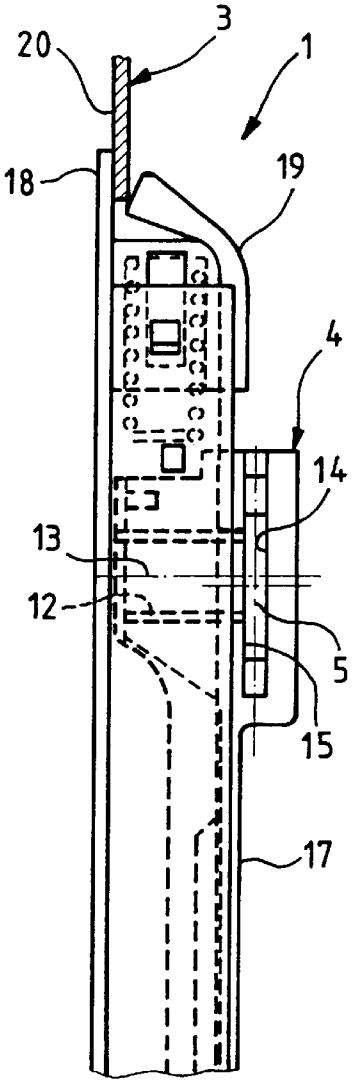
FIG. 1 is a fragmentary view in elevation of a fitting constituting one embodiment of the present invention.
Figure 2:
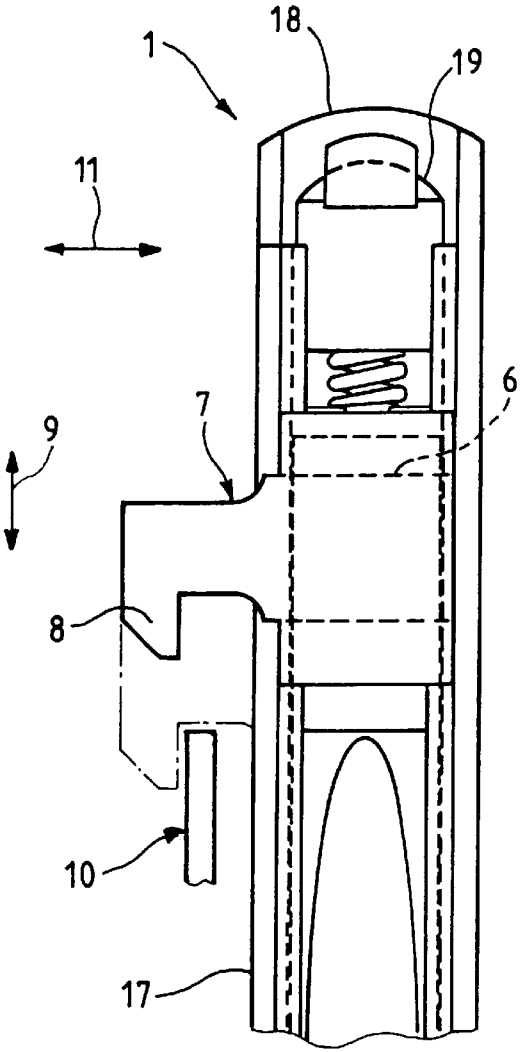
FIG. 2 is a view of the fitting from FIG. 1 as seen from the right in FIG. 1.

In the embodiment shown in FIGS. 1 to 3 the fitting 1 with adjustable bolt for a sliding door, window or like closure 3 includes a bolt-carrier 4 having at least one slot 5 adapted to receive the tail 6 of a bolt 7 carrying at least one hook 8 (see FIG. 2). The bolt-carrier 4 is adapted to slide in the transverse direction 9 of the slot 5 to engage the hook 8 of the bolt 7 with a striker 10 on the frame and to release the hook 8 from the striker 10, which is shown symbolically in FIG. 2.

The bolt 7 is adapted to slide in the longitudinal direction 11 of the slot 5 to enable adjustment of the bolt 7 relative to the striker 10.

The bolt-carrier 4 includes at least one screwthreaded hole 12 with its axis 13 perpendicular to the walls 14, 15 of the slot 5 and adapted to receive an immobilizing screw 16 for immobilizing the tail 6 of the bolt 7 against the wall 14 of the slot 5 in the bolt-carrier 4 opposite the screw 16.

In the example shown the fitting 1 includes a casing 17 including a covering plate 18. Each end of the fitting 1 is fixed to the wall 20 on the inside of the closure 3 by a fixing member 19 of any type. This structure is in no way mandatory.

In accordance with the present invention the tail 6 of the bolt 7 includes at least one opening 21 extending in the longitudinal direction 11 of the slot 5 and the screw 16 is adapted to bear on at least one edge 22, 23 of the opening 21. In the example shown in detail in FIGS. 4 and 5 the tail 6 of the bolt 7 includes an opening 21 centered on the median axis 24 of the tail 6 of the bolt 7.

The longitudinal edges 22, 23 of the opening 21 have teeth 25 projecting towards the opposite edge 23, 22.

The axis 13 of the screw 16 intersects the median axis 24 so that the screw 16 is centered in the opening 21 and bears on the edges 22 and 23 and more particularly on the teeth 25 of those edges.

In the conventional way the bolt 7 includes two hooks 8*a,* 8*b* projecting in opposite directions in the transverse direction 9 of the tail 6 of the bolt 7 which is coincident with the transverse direction of the slot 5 receiving said tail 6.

The tail 6 of the bolt 7 is connected to the hooks 8*a,* 8*b* by a cranked core 26.

A completely reversible bolt has therefore been described that can be introduced into the bolt-carrier in any manner, the hooks 8*a,* 8*b* projecting in the longitudinal direction 11 from any side of the bolt-carrier 4, that is to say to the right or to the left of the fitting from FIG. 3, any face of the bolt 4 being visible in said FIG. 3, to offer the most solutions possible with a single fitting and with a single bolt for adapting to the particular structure of the closure and the frame concerned.

In this way, with a bolt extending in a plane and with bolts cranked differently, in small numbers, caters for all possible situations of a sliding closure and a corresponding frame.

Figure 7:
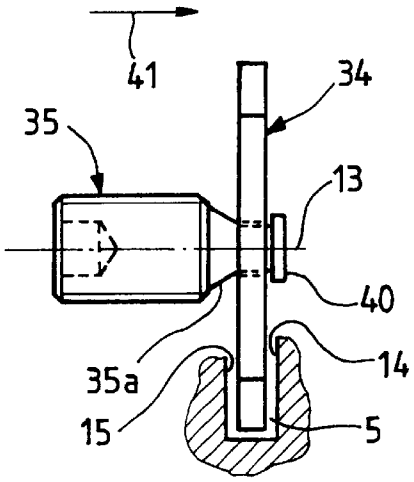
FIG. 7 is a profile view of the bolt from FIG. 6 showing an adjuster screw engaged with said bolt.
Figure 8:
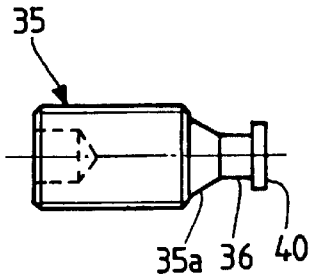
FIG. 8 is a view in elevation of the screw from FIG. 7.
Figure 6:
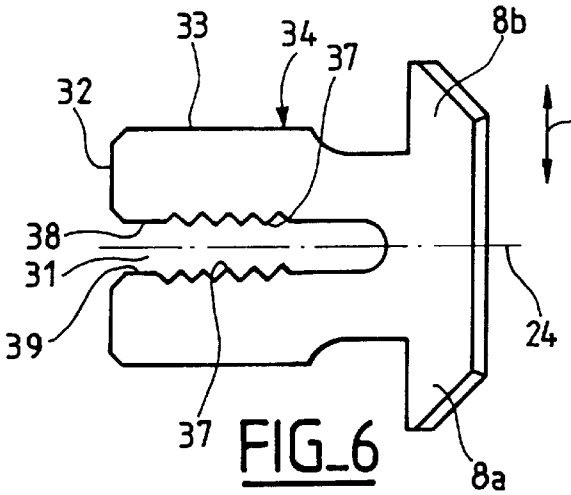
FIG. 6 is a view in elevation of another embodiment of a bolt adapted to be mounted on the fitting from FIG. 1.

In the embodiment shown in FIGS. 6 to 8 the opening 31 opens onto the rear edge 32 of the tail 33 of the bolt 34 opposite the hooks 8*a,* 8*b.* The screw 35 has at its free end adapted to come into contact with the tail 33 of the bolt 34 a pointed frustoconical shape 35*a* continuing through a cylindrical part 36 of small diameter adapted to pass between the teeth 37 on the longitudinal edges 38, 39 of the opening 31 and terminating in a flange 40 adapted to be retained on the other side of the tail 33 of the bolt 34 relative to the screw 35.

The screw 35 is therefore introduced into the bolt-carrier 4 after which the tail 33 of the bolt 34 is inserted into the bolt-carrier, the longitudinal edges 38, 39 being inserted on respective opposite sides of the cylindrical part 36 of the screw 35 which is thereby trapped. When the screw 35 is screwed in the frustoconical part 35*a* bears on the longitudinal edges 38, 39 and deforms those edges towards the wall 14 of the slot 5 in the transverse direction 9 and in the direction 41 of the axis 13 of the screwthreaded hole 12 and of the screw 35. When the screw 35 is unscrewed the bolt can be moved freely in the longitudinal direction 11 with the closure in the open position. The fitting therefore has a bolt-carrier with a single screwthreaded hole and allowing adjustment of the bolt 34 only in the open position of the closure. It suffices to loosen the screw 35 to carry out this adjustment, without having to unscrew it and remove it.

Figure 9:
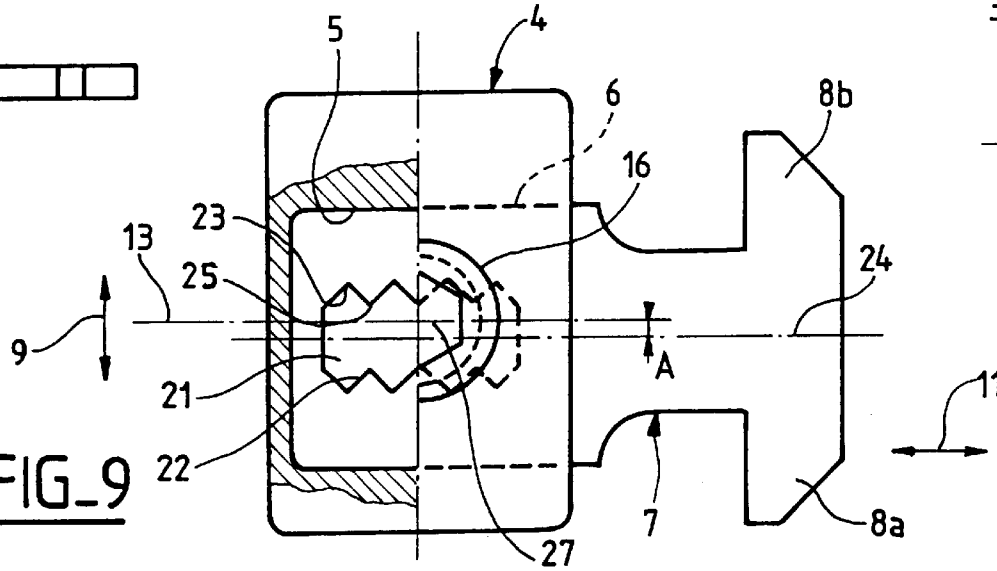
FIG. 9 is a view to a larger scale of a detail from FIG. 3.
Figure 4:
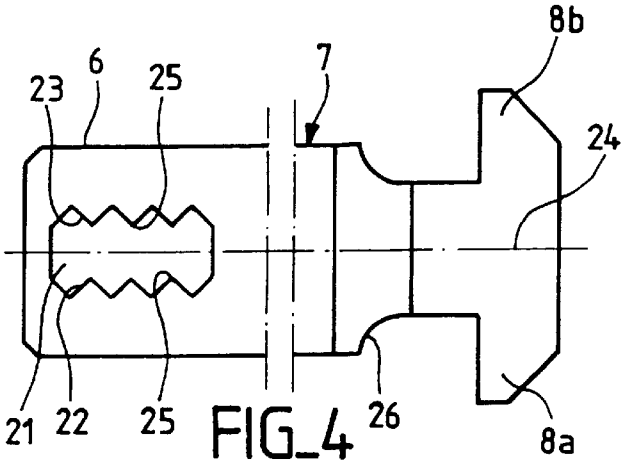
FIG. 4 is an elevation view of a bolt adapted to be used on the fitting from FIGS. 1 to 3.
Figure 5:
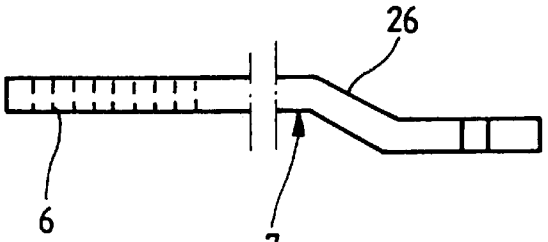
FIG. 5 is a profile view of the bolt from FIG. 4.

In the embodiment shown in FIG. 9, which corresponds to a bolt of the type described with reference to FIGS. 4 and 5, the axis 13 of the screwthreaded hole 12 is offset relative to the median axis 24 of the opening 21 and of the tail 6 of the bolt 7 by a distance A. A tool (not shown) inserted into the screwthreaded hole 12 in place of the screw 16 can therefore bear against the teeth 25 on one edge 22 of the opening 21 to move the tail 6 of the bolt 7 in the longitudinal direction 11.

The tool can be a crosshead screwdriver, for example, the end of which has teeth which can engage with the teeth 25 to move the bolt.

The screw 16 is usually a hexagonal socket head screw or grubscrew with a hexagonal section socket adapted to receive a male tool of appropriate section for turning the screw.

In an advantageous version the same screw 16 advantageously has a hole 27 through it in the direction of the axis 41 for a tool for moving the tail of the bolt in the transverse direction 11. The tool engages directly with one of the teeth 25 on one of the edges 22, 23. The tool can cooperate with the teeth only because the axis of the screw is offset from the median axis of the tail of the bolt, with the result that only one edge 22, 23 is accessible via the hole 27.

There is therefore no possibility of confusing the two tools, one for tightening and the other for adjusting. The advantage of this solution is naturally that of combining two functions in one and the same screw in one and the same screwthreaded hole in the bolt-carrier 4, which is thereby less fragile that in other solutions with two or more holes.

Figures 10, 11, 12, 17:
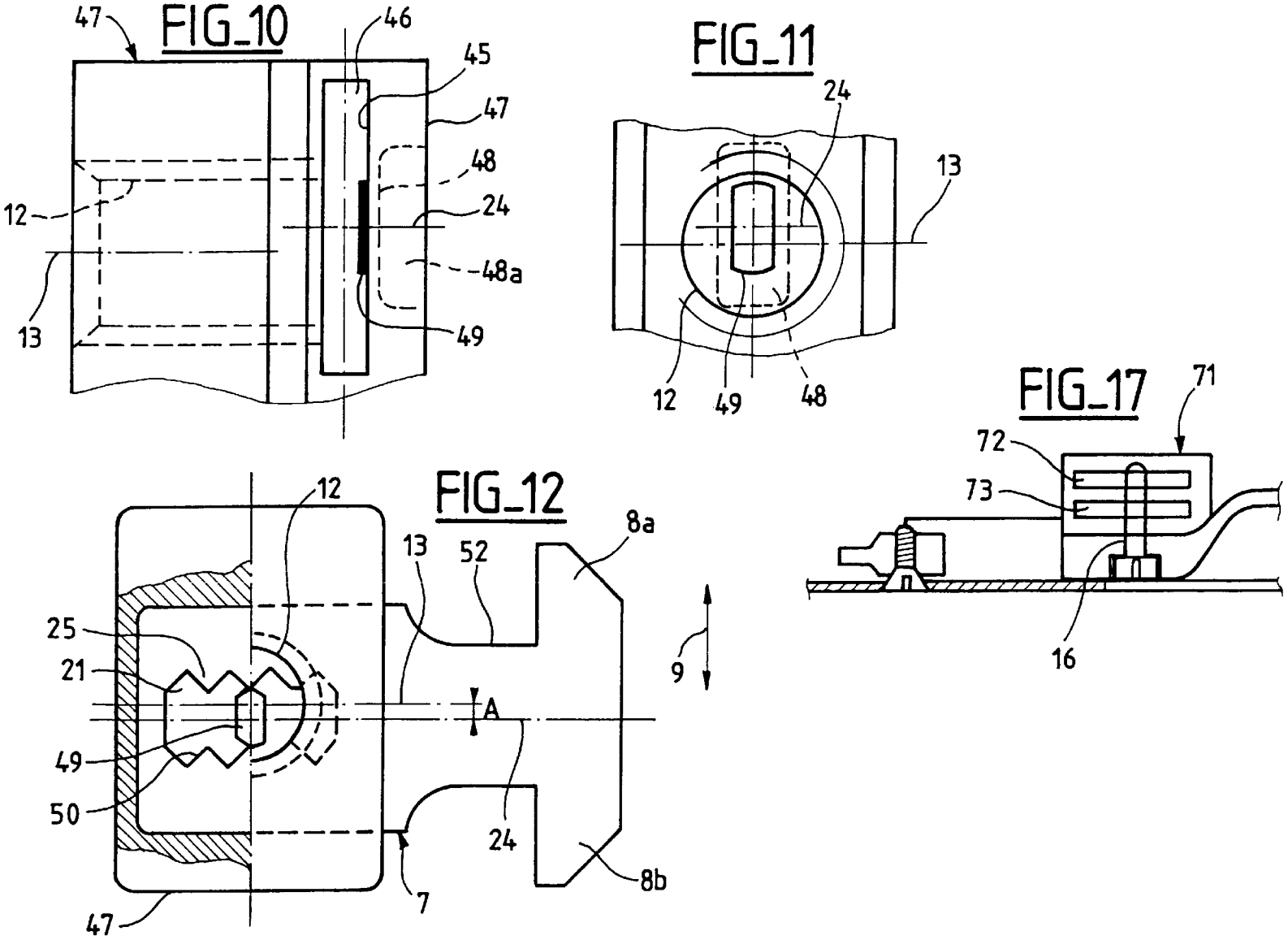
FIG. 10 is a view to a larger scale of a detail from FIG. 1 showing another embodiment of the fitting in accordance with the present invention.
FIG. 11 is a bottom view of the detail from FIG. 10.
FIG. 12 is a view similar to FIG. 9 corresponding to the embodiment of FIGS. 10 and 11.
FIG. 17 is a diagrammatic view similar to FIG. 1 of another embodiment of the fitting in accordance with the present invention.
Figure 13:
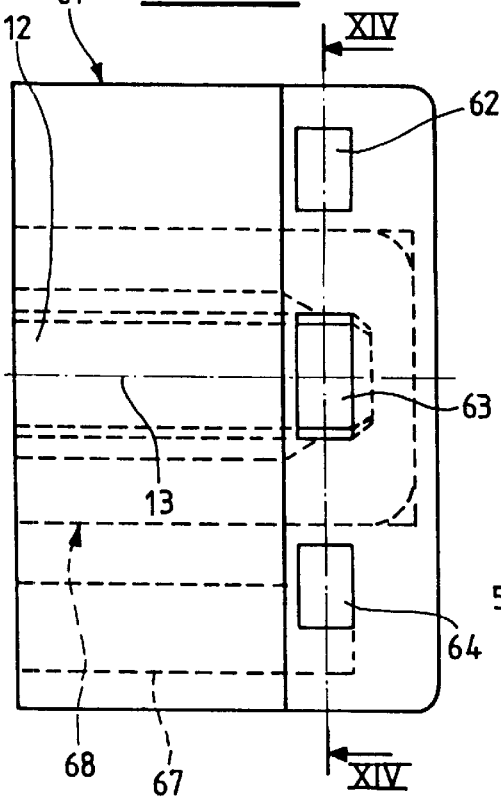
FIG. 13 is a view to a larger scale of a detail from FIG. 1 concerning another embodiment of the fitting in accordance with the present invention, the bolt being omitted to simplify the figure.

In the embodiment shown in FIGS. 10 to 12 the wall 45 of the slot 46 in the bolt-carrier 47 opposite the screwthreaded hole 12 includes a thinner part 48 having a member 49 projecting slightly towards the interior of the slot 46. The length of the member 49 in the direction 9 is such that the member is flush with the tips 50 of the teeth 25 of the opening 21 (see FIG. 12). Because of this reduced thickness, the projecting member 49 that cooperates with the tips 50 of the teeth 25 is adapted to hold the tail of the bolt in position in the slot 46, opposing only a predetermined weak spring force to movement of the bolt 7 in the longitudinal direction 11.

The thinner wall 48 and the projecting member 49 can easily be made, for example by molding. The thinner wall is obtained by providing the corresponding recess 48*a* on the outside face 47*a* of the bolt-carrier 47, for example. The projecting member 49 is obtained in a manner known in itself, for example, by providing a corresponding recess in a mold slide (not shown) enabling the slot 46 to be molded.

The advantage of the projecting member 49 on the thinner wall 48, which thereby has some elasticity, is the ability to preposition the bolt 7 easily by hand in the slot 46 with the closure open.

To move the bolt 7 a tool, for example a crosshead screwdriver, can be inserted into the screwthreaded hole 12, bearing against the teeth 25 to move the bolt 7 against the spring pressure of the projecting member 49, and then to turn the immobilizing screw 16. The bolt can thus be adjusted with the closure in the closed position by means of a single hole 12 in the bolt-carrier 47. The tool can also be inserted into the hole 27 through a screw 16 provided with a hole of this kind.

In the embodiment shown in detail in FIGS. 13 to 16 the tail 51 of the bolt 52 has three arms 53, 54, 55 extending from the core 56 of the bolt 52 in the longitudinal direction 11 and forming between them two openings 57, 58 symmetrical to each other about the median axis 59 of the tail 51 of the bolt 52.

Figure 14:
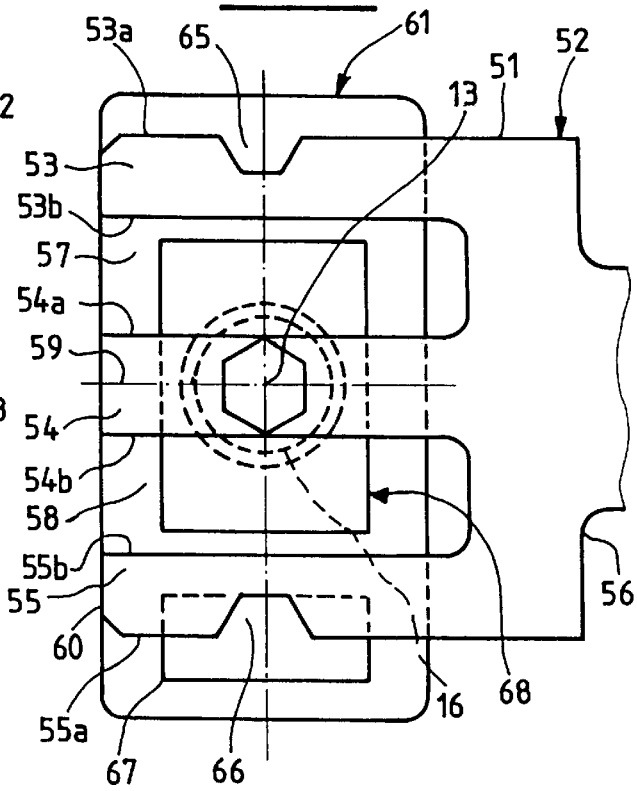
FIG. 14 is a view in section taken along the line XIV—XIV in FIG. 13 showing the bolt in position in the slot of the bolt-carrier.
Figure 16:
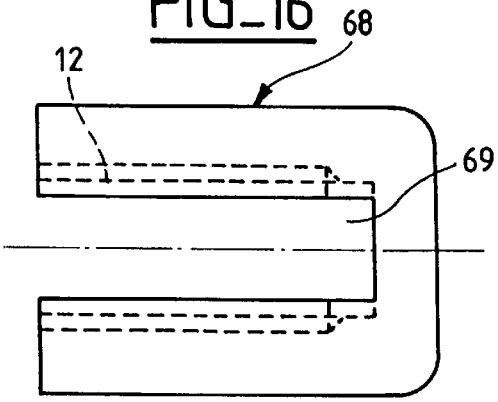
FIG. 16 is a view in section taken along the line XVI—XVI in FIG. 15.
Figure 15:
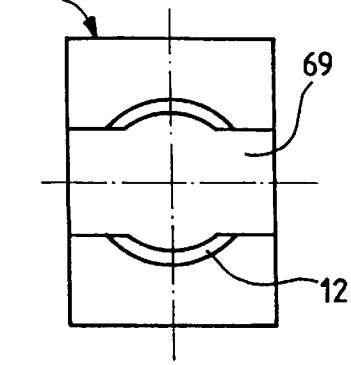
FIG. 15 is a view of a detail from FIG. 14.

As shown in FIG. 14 in particular the openings 57, 58 open onto the rear edge 60 of the tail 51 of the bolt 52 opposite the core 56. The bolt-carrier 61 includes three slots 62, 63, 64 in the same plane and adapted to receive a respective corresponding arm 53, 54, 55 of the tail 51 of the bolt 52.

In this example the axis 13 of the screw 16 intersects the median axis 59 of the central arm 54 and the screw 16 has a diameter greater than the width of the arm 54 and presses on both edges 54*a*, 54*b* of said arm 54. The width of the arm 54 is such that the arm 54 can be deformed by the pressure of the screw 16.

Each of the two outside arms 53, 55 has on one edge, for example the outside edge 53*a*, 55*a* or the inside edge 53*b*, 55*b*, at least two detents 65, 66 opposite each other and projecting from the same side relative to said edge 53*a*, 55*a*, 53*b*, 55*b* in the transverse direction 9. The bolt-carrier 61 includes a second hole 67 into which a tool can be inserted to bear on one of the detents 65, 66 on the corresponding edge 53*a*, 55*a*, 53*b*, 55*b* to move the tail 51 of the bolt 52 one way or the other.

To allow a single tool to be used to adjust, tighten and immobilize the bolt and the screw 16 shown being a hexagon socket grub screw having a hexagonal section socket adapted to receive an Allen key, the detents 65 and 66 are configured so that each represents half the hexagon.

In the example shown the bolt-carrier 61 is made of plastics material and includes a metallic insert 68 in which are formed the screwthreaded hole 12 and a slot 69 adapted to receive the central arm 54 of the tail 51 of the bolt 52.

In the example shown diagrammatically in FIG. 17 the bolt-carrier 71 includes two parallel slots 72, 73 spaced from each in the direction 41 of the axis 13 perpendicular to the walls of the slots 72, 73.

The screwthreaded hole 12 is adapted to receive screws 16 of different lengths according to which of the slots 72, 73 the tail 6, 33 of the bolt 7, 34 to be immobilized is in.

Of course, the present invention is not limited to the embodiments just described and many changes and modifications can be made to the latter without departing from the field of the invention.

What is claimed is:

1. A fitting for a sliding closure such as a door or a window, said fitting comprising an elongate casing extending in a first direction, said casing being integral with a covering plate and being adapted to be introduced longitudinally in and fixed on an inside wall of a stile of the sliding closure, said fitting further comprising a bolt-carrier slidable in said first direction inside the stile along said casing, said bolt-carrier having at least one slot which is limited by two main walls parallel to the inside wall and which extends through said bolt-carrier in a second direction perpendicular to said first direction, said slot being adapted to receive therein a substantially flat tail of a bolt protruding in said second direction from the stile and carrying at least one hook extending in said first direction, said bolt-carrier slidable in said first direction to engage said hook of said bolt with a striker on a frame of the sliding closure and to release said hook from said striker, said bolt tail being slidable in said second direction inside said slot to adjust said bolt relative to said striker, said bolt-carrier including at least one screwthreaded hole having an axis perpendicular to the inside wall of the stile and to said main walls of said slot in said bolt-carrier and adapted to receive an immobilizing screw for immobilizing said tail of said bolt against a first main wall of said slot opposite said screw, said screw being actuated from the inside wall, wherein said tail of said bolt includes at least one elongate opening extending in said second direction of said slot and said screw is adapted to bear on at least one of two longitudinal edges of said opening so as to press and deform said at least one of two longitudinal edges against said first main wall.

2. The fitting of claim 1 wherein said opening of said tail of said bolt is centered on a median axis of said tail of said bolt or wherein said tail of said bolt includes two openings symmetrical to each other about said median axis, said bolt includes two hooks projecting opposite ways in said first direction of said tail of said bolt and said tail of said bolt is connected to said hooks by a cranked core.

3. The fitting of claim 1 wherein each of said longitudinal edges of said opening of said tail of said bolt includes teeth projecting towards an opposite edge.

4. The fitting of claim 3 wherein said opening opens onto a rear edge of said tail of said bolt opposite said hook and said screw has at a free end adapted to come into contact with said tail of said bolt a pointed frustoconical shape continuing via a small diameter cylindrical part adapted to pass between said teeth of said opening and terminating in a flange adapted to be held on an opposite side of said tail of said bolt relative to said screw.

5. The fitting of claim 3 wherein said axis of said screwthreaded hole is offset relative to a median axis of said opening by a distance just sufficient to allow a tool introduced into said screwthreaded hole to bear on said teeth on one edge of said opening to move said tail of said bolt in said second direction.

6. The fitting of claim 5 wherein said bolt-carrier includes two parallel slots spaced from each other in a direction perpendicular to walls of said slots and said screwthreaded hole is adapted to receive screws of different lengths according to whether said tail of said bolt to be immobilized is in one or other of said slots.

7. The fitting of claim 5 wherein a wall of said slot of said bolt-carrier opposite said screwthreaded hole has a thinner part with a member projecting slightly towards an inside of said slot and extending in said first direction of said slot a distance such that said member is flush with tips of said teeth of said opening.

8. The fitting of claim 2 wherein said tail of said bolt has three arms extending from said core of said bolt in said second direction and forming between them said two openings symmetrical to each other about said median axis of said tail of said bolt.

9. The fitting of claim 8 wherein said two openings open onto a rear edge of said bolt opposite said core and said bolt-carrier includes three slots in a same plane as said three arms and adapted to receive a respective corresponding arm of said tail of said bolt.

10. The fitting of claim 8 wherein at least two detents are included on two outside arms, said at least two detents opposite each other on a corresponding edge of said two outside arms and projecting from a same side relative to said edge in said first direction and said bolt-carrier includes a second hole enabling a tool to be inserted to bear on one or other of said detents of the corresponding edge to move said tail of said bolt one way or another.

11. The fitting of claim 8 wherein said bolt-carrier is made of plastics material and includes a metallic insert in which are formed said screwthreaded hole and a slot adapted to receive a central arm of said tail of said bolt.

* * * * *